US008098057B2

(12) United States Patent
Morino

(10) Patent No.: US 8,098,057 B2
(45) Date of Patent: Jan. 17, 2012

(54) CONSTANT VOLTAGE CIRCUIT INCLUDING SUPPLY UNIT HAVING PLURAL CURRENT SOURCES

(75) Inventor: Koichi Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 437 days.

(21) Appl. No.: 12/360,348

(22) Filed: Jan. 27, 2009

(65) Prior Publication Data

US 2009/0195227 A1 Aug. 6, 2009

(30) Foreign Application Priority Data

Feb. 5, 2008 (JP) ..... 2008-025194
Mar. 26, 2008 (JP) ..... 2008-081336

(51) Int. Cl.
*G05F 1/59* (2006.01)

(52) U.S. Cl. ..... 323/269; 323/280

(58) Field of Classification Search ..... 323/269, 323/273, 280, 281
See application file for complete search history.

(56) References Cited

U.S. PATENT DOCUMENTS

| | | | | |
|---|---|---|---|---|
| 7,106,032 | B2 * | 9/2006 | Chen et al. | 323/269 |
| 2008/0116862 | A1 * | 5/2008 | Yang et al. | 323/269 |
| 2010/0181972 | A1 * | 7/2010 | Kawagoshi | 323/269 |

FOREIGN PATENT DOCUMENTS

| | | |
|---|---|---|
| JP | 3-158912 | 7/1991 |
| JP | 2004-240646 | 8/2004 |
| JP | 2006-99526 | 4/2006 |

* cited by examiner

*Primary Examiner* — Jeffrey Sterrett
(74) *Attorney, Agent, or Firm* — Cooper & Dunham LLP

(57) ABSTRACT

A constant voltage circuit configured to convert an input voltage into an output voltage having a predetermined level is disclosed. The constant voltage circuit includes a differential amplifier circuit configured to produce an output signal having a voltage level in response to a reference voltage and the output voltage; and an output circuit configured to receive the output signal and produce a current in response to the voltage level of the output signal. The output voltage is proportional to the current. The output circuit includes plural output transistors and a transistor selecting unit configured to select one or more output transistors to be operated among the plural output transistors to produce the current depending on the level of the output voltage.

10 Claims, 8 Drawing Sheets

CONSTANT VOLTAGE CIRCUIT INCLUDING SUPPLY UNIT HAVING PLURAL CURRENT SOURCES

BACKGROUND

1. Technical Field

This disclosure relates to a constant voltage circuit, and more particularly to a constant voltage circuit capable of making a quick response to a wide range of output currents such as a minute current and a large current, and capable of stable operation with high efficiency.

2. Description of the Related Art

In electronic devices such as portable phones, mobile PCs, and car navigation systems, a constant voltage power source having a constant voltage circuit and capable of supplying a stable voltage is used as a power source. When using such a constant voltage power source in a device with a large output current, the constant voltage power source is required to have a circuit configured to realize a high speed response by improving a ripple removing ratio and a load transient response. For example, when the constant voltage power source is used in a device with a wide range of output current, such as a portable phone having an operation mode and a standby mode, a circuit configuration capable of receiving a maximum output current is required. As a result, a current consumption is increased as a whole. In the standby mode of the portable phone, in which a high ripple removing ratio and a high load transient response are not required, an unnecessary current is consumed, which results in increasing the wasted current. In view of this, a constant voltage circuit for suppressing this wasted power consumption has been suggested.

Each of Patent Documents 1 and 2 discloses a constant voltage circuit configured to increase or decrease a bias current supplied to a differential amplifier in the constant voltage circuit depending on the amount of output current.

FIG. 8 shows the constant voltage circuit disclosed in Patent Document 1. In FIG. 8, a constant voltage circuit 101 includes a reference voltage circuit Vref, a differential amplifier circuit 102, a bias current generating circuit 103, and an output circuit 104.

In this circuit, a PMOS transistor M7 and an output transistor M1 form a current mirror circuit. Therefore, a drain current in proportion to a drain current (output current) of the output transistor M1 is generated in the PMOS transistor M7. This current is supplied as a drain current of an NMOS transistor M8. Since the NMOS transistor M8 and an NMOS transistor M9 form a current mirror circuit, a drain current of the NMOS transistor M9 is in proportion to the drain current of the output transistor M1. The drain current of the NMOS transistor M9 is a part of a bias current of the differential amplifier circuit 102, therefore, the bias current of the differential amplifier circuit 102 increases and decreases in accordance with an increase and a decrease of the output current.

In this manner, the bias current of the differential amplifier circuit 102 is increased and decreased in accordance with the increase and decrease of the output current. Therefore, a response speed is increased when the output current is increased. In this manner, the current consumption and the response speed are set appropriately.

[Patent Document 1] Japanese Patent Application Publication No. 3-158912

[Patent Document 2] Japanese Patent Application Publication No. 2006-99526

In the constant voltage circuits configured to change the bias current of the differential amplifier circuit in accordance with the output current as disclosed in Patent Documents 1 and 2, an operation of the constant voltage circuit becomes unstable when the output current is small. That is, for example, a constant voltage power source having a large output transistor a capable of outputting an output current of 1 A or more can be stably operated when the output current is large. However, this constant voltage power source cannot be stably operated when the output current is small since a bias current of a differential amplifier circuit becomes small and a phase margin is decreased. Moreover, there is a problem in that a response speed is extremely low when the bias current is small. This is because a transistor having a large ratio of gate width to gate length and thus having large gate capacitance is used as an output transistor to realize an operation with a large current. When a bias current is small, it takes time to charge and discharge the gate capacitance. Therefore, the response speed is drastically decreased when the output current is small.

SUMMARY

The present invention is made in view of the aforementioned circumstances and it is an object of at least one embodiment of the present invention to provide In an aspect of this disclosure, there is provided a constant voltage circuit of which response speed is not decreased when an output current is small and which operates stably with a wide range of amounts of output current.

According to another aspect, a constant voltage circuit configured to convert an input voltage into an output voltage having a predetermined level includes a differential amplifier circuit configured to produce an output signal having a voltage level in response to a reference voltage and the output voltage; and an output circuit configured to receive the output signal and produce a current in response to the voltage level of the output signal. The output voltage is proportional to the current. The output circuit includes plural output transistors and a transistor selecting unit configured to select one or more output transistors to be operated among the plural output transistors to produce the current depending on the level of the output voltage.

According to another aspect, a constant voltage circuit configured to convert an input voltage into an output voltage having a predetermined level includes a differential amplifier circuit configured to produce an output signal having a voltage level determined in response to a reference voltage and the output voltage; an output circuit including at least a first transistor, a second transistor, and a first switching unit configured to supply a current supplied by the second transistor to be added to a current supplied by the first transistor to produce a combined current or block the current supplied by the second transistor depending on the voltage level of the output signal of the differential amplifier circuit. The output circuit is configured to produce an output current of the current supplied by the first transistor or the combined current in response to the voltage level of the output signal of the differential amplifier circuit. The output voltage is proportional to the output current. The constant voltage circuit further includes a bias current supply circuit including at least a first current source, a second current source, and a second switching unit configured to supply a current supplied by the second current source to be added to a current supplied by the first current source to produce a combined current source or block the current supplied by the second current source. The bias current supply circuit is configured to supply a bias current of the first current source or the combined current source to the differential amplifier circuit. The constant voltage circuit further includes a determination circuit configured to control switching of the second switching unit depending on the voltage level of the output signal of the differential amplifier circuit.

According to another aspect, a constant voltage circuit configured to convert an input voltage into an output voltage having a predetermined level includes a voltage input terminal, a voltage output terminal, a constant voltage circuit unit, and a determination circuit unit. The constant voltage circuit unit includes an output circuit and a differential amplifier circuit. The output circuit includes a first transistor, a second transistor, a first switching unit, and a sixth switching unit. The first and second transistors have sources connected together to the voltage input terminal, drains connected together to the voltage output terminal, and gates connected to each other through the first switching unit. The gate of the second transistor is connected to the voltage input terminal through the sixth switching unit. The differential amplifier circuit has a non-inverting input terminal receiving a first reference voltage, an inverting input terminal receiving a divided voltage of the output voltage, an output terminal connected to the gate of the first transistor. A first current source and a second current source are connected in parallel to each other as bias current supply sources, and a second switching unit is connected between the first and second current sources. The determination circuit unit includes a current supply circuit and a comparator. The current supply circuit includes a third transistor and a fourth transistor having sources connected together to the voltage input terminal, drains connected to each other, and gates connected to the gates of the first and second transistors respectively. The determination circuit unit further includes a third current source, a third switching unit, and a fourth switching unit which are connected in series between the sources and drains of the third and fourth transistors in parallel to the third and fourth transistors. The comparator has a non-inverting input terminal connected to the drains of the third and fourth transistors which are connected together and an inverting input terminal to which one of a second reference voltage and a third reference voltage is selectively connected through a fifth switching unit, and an output terminal to output an output signal. The first, second, and sixth switching units in the constant voltage circuit unit and the third to fifth switching units in the determination circuit unit are controlled by the output signal of the comparator.

DETAILED DESCRIPTION OF THE PREFERRED EMBODIMENTS

Hereinafter, embodiments of the present invention are described with reference to the drawings.

Figure 1:
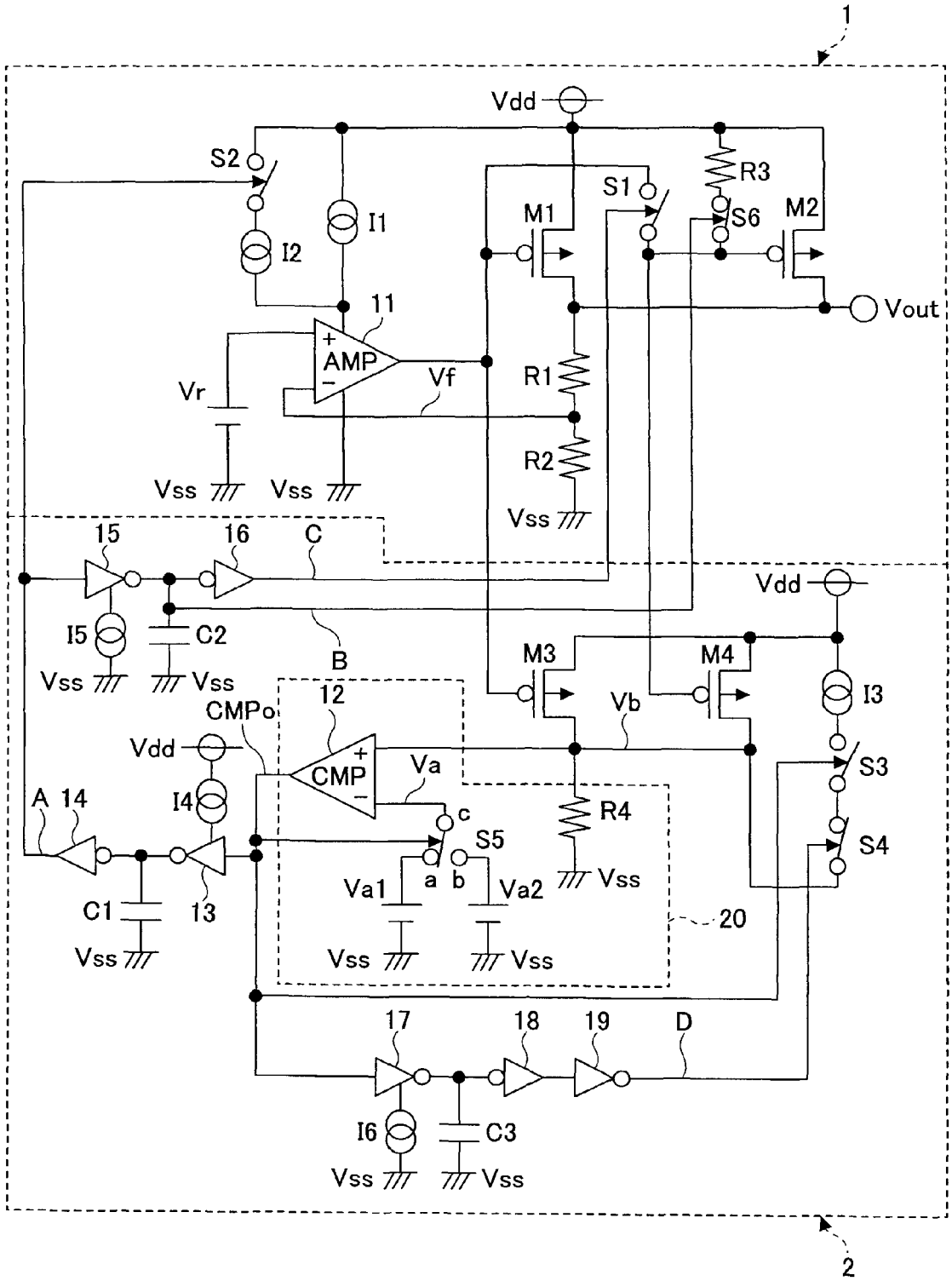
FIG. 1 is a constant voltage circuit of an embodiment of the present invention.

FIG. 1 shows a constant voltage circuit of an embodiment of the present invention. This constant voltage circuit includes a constant voltage circuit unit 1 and a determination circuit unit 2. The constant voltage circuit unit 1 outputs a predetermined constant voltage output Vout from a voltage output terminal in response to an input voltage Vdd inputted from a voltage input terminal. The determination circuit unit 2 monitors an output current of the constant voltage circuit unit 1 and compares the output current with a predetermined value. The determination circuit unit 2 then transmits a comparison result to the constant voltage circuit unit 1, thereby switches S1, S2, and S6 of the constant voltage circuit unit 1 are controlled.

The constant voltage circuit unit 1 includes a reference voltage source Vr, a differential amplifier 11, bias current sources I1 and I2, a first output transistor M1, a second output transistor M2, resistors R1 to R3, the switches S1, S2, and S6, an input terminal Vdd, and an output terminal Vout. Further, the determination circuit unit 2 includes PMOS transistors M3 and M4, a comparator 12, a first reference voltage source Va1, a second reference voltage source Va2, inverters 13 to 19, current sources I3 to I6, capacitors C1 to C3, a resistor R4, and switches S3 to S5.

In this configuration, an outline of the constant voltage circuit is described.

In the constant voltage circuit unit 1, a current of the current source I1 is always applied as a bias current of the differential amplifier 11. When a load current of the constant voltage circuit is increased, that is when an output current is increased, the switch S2 is turned on, thereby a current of the current source I2 is additionally supplied to the current of the current source I1 as a bias current of the differential amplifier 11. In this manner, when the output current is small, only the current source I1 is used. When the output current is large, on the other hand, the currents of the current sources I1 and I2 are used as a bias current of the differential amplifier 11. Similarly, as for the output transistors, the first output transistor M1 is always used. On the other hand, the second output transistor M2 is used only when the output current is large. That is, when the output current is small, only the first output transistor M1 is used. When the output current becomes large, the switch S1 is turned on while the switch S6 is turned off. In this manner, the first output transistor M1 and the second output transistor M2 are both used.

Here, the current source I2 and the second output transistor M2 are larger in size than the current source I1 and the first output transistor M1 respectively. By using the second output transistor M2, the circuit may oscillate. In the configuration of the determination circuit unit 2 of this embodiment, oscillation of the circuit is prevented. This prevention of oscillation will be described in detail below.

Hereinafter, the embodiment of the present invention is described in detail.

In the constant voltage circuit unit 1 shown in FIG. 1, the reference voltage Vr is inputted to a non-inverting input terminal of the differential amplifier 11. A detection voltage Vf obtained by dividing an output voltage Vout by the resistors R1 and R2 is inputted to an inverting input terminal of the differential amplifier 11. The other terminal of the resistor R2 is connected to ground potential Vss. An output of the differential amplifier 11 is connected to a gate of the first output transistor M1 formed of a PMOS transistor. The first output transistor M1 has a source connected to the input terminal Vdd and a drain connected to the output terminal Vout. A source and a drain of the second output transistor M2 formed of a PMOS transistor are connected to the source and the drain of the first output transistor M1 respectively. A gate of the second output transistor M2 is connected to the output of the differential amplifier 11 through the switch S1. The gate of the second output transistor M2 is pulled-up to the input terminal voltage Vdd through the switch S6 and the resistor R3. The current source I1 capable of always supplying a bias current is connected to the differential amplifier 11 between the input terminal Vdd and the differential amplifier 11. Moreover, the current source I2 and the switch S2 which are connected in series are connected in parallel to the current source I1.

When the output current is small in the constant voltage circuit unit 1, the switches S1 and S2 are turned off and the switch S6 is turned on. In addition, only the first output transistor M1 is operated as an output transistor and only the first current source I1 is used as a current source. When the output current is large, on the other hand, the switches S1 and S2 are turned on and the switch S6 is turned off. Then, both the first output transistor M1 and the second output transistor M2 are operated as output transistors, and the first and second current sources I1 and I2 are both operated as current sources. This will be described in detail below.

Next, the determination circuit unit 2 is described.

A source and a gate of the PMOS transistor M3 are connected to the source and the gate of the first output transistor M1 respectively. That is, the source of the PMOS transistor M3 is connected to the input terminal Vdd. In this manner, the PMOS transistor M3 and the first output transistor M1 form a current mirror circuit. The output current is monitored by the PMOS transistor M3. Similarly, a source and a gate of the PMOS transistor M4 are connected to the source and gate of the second output transistor M2 respectively. The PMOS transistor M4 and the second output transistor M2 form a current mirror circuit. Drains of the PMOS transistors M3 and M4 are connected together and grounded through the resistor R4. The resistor R4 functions as a current voltage converter capable of converting a drain current of the PMOS transistors M3 and M4 into a voltage. As described above, the PMOS transistors M3 and M4 form current mirror circuits with the first output transistor M1 and the second output transistor M2 respectively. Therefore, the drain current of the PMOS transistors M3 and M4 is in proportion to the output current. Since the resistor R4 converts this current into a voltage, a voltage drop Vb at the resistor R4 is in proportion to the output current. The switches S3 and S4 are connected in series to the current source I3. These serially connected switches are connected between the sources and drains of the PMOS transistors M3 and M4. The voltage Vb is inputted to a non-inverting input terminal of the comparator 12. An inverting input terminal of the comparator 12 is connected to a common terminal c of the switch S5. The first reference voltage source Va1 is connected between a terminal a of the switch S5 and ground potential Vss. The second reference voltage source Va2 is connected between a terminal b and ground potential Vss. Here, the second reference voltage source Va2 is set lower than the first reference voltage Va1. An output CMPo of the comparator 12 is connected to inputs of the inverters 13 and 17, and control terminals of the switches S3 and S5. A capacitor C1 is connected between an output of the inverter 13 and ground potential Vss and to an input of the inverter 14. A current source I4 is connected between a positive side power source terminal of the inverter 13 and the input terminal Vdd. An output A of the inverter 14 is connected to an input of the inverter 15 and a control terminal of the switch S2 in the constant voltage circuit unit 1. The capacitor C2 is connected between an output B of the inverter 15 and ground potential Vss. Moreover, the output B of the inverter 15 is connected to an input of the inverter 16. The output B of the inverter 15 is connected to a control terminal of the switch S6 of the constant voltage circuit unit 1. An output C of the inverter 16 is connected to a control terminal of the switch S1 in the constant voltage circuit unit 1. Further, a current source I5 is connected between a negative side power source terminal of the inverter 15 and ground potential Vss. The capacitor C3 is connected between an output of the inverter 17 and ground potential Vss. The output of the inverter 17 is connected to an input of the inverter 18. A current source I6 is connected between the negative side power source terminal of the inverter 17 and ground potential Vss. An output of the inverter 18 is connected to an input of the inverter 19. An output D of the inverter 19 is connected to a control terminal of the switch S4.

Here, the inverters 17 to 19, the current source I6, and the capacitor C3 form a first delay circuit. By the first delay circuit, the output CMPo of the comparator 12 is delayed for a delay time of Td3 and transmitted to the control terminal of the switch S4. The inverters 13 and 14, the current source I4, the capacitor C1, the inverters 15 and 16, the current source I5, and the capacitor C2 form a second delay circuit. By the second delay circuit, the output CMPo of the comparator 12 is delayed for a delay time Td1 or Td2 and transmitted to the switches S1, S2, and S6. These delay times Td1 to Td3 are described in detail below.

The determination circuit unit 2 determines whether the output current is larger or smaller than a predetermined value. In response to this determination, the switches S1, S2, and S6 of the constant voltage circuit unit 1 are controlled and the second output transistor M2 and the second current source I2 are turned on or off (these elements are used or not used).

The switches S1 to S4 and S6 are turned on when a high level (H-level) signal is inputted to control terminals and turned off when a low level (L-level) signal is inputted to the control terminals. The common terminal c and the terminal a of the switch S5 are connected when an L-level signal is inputted to a control terminal, and the common terminal c and the terminal b are connected when an H-level signal is inputted to the control terminal.

Figure 2:
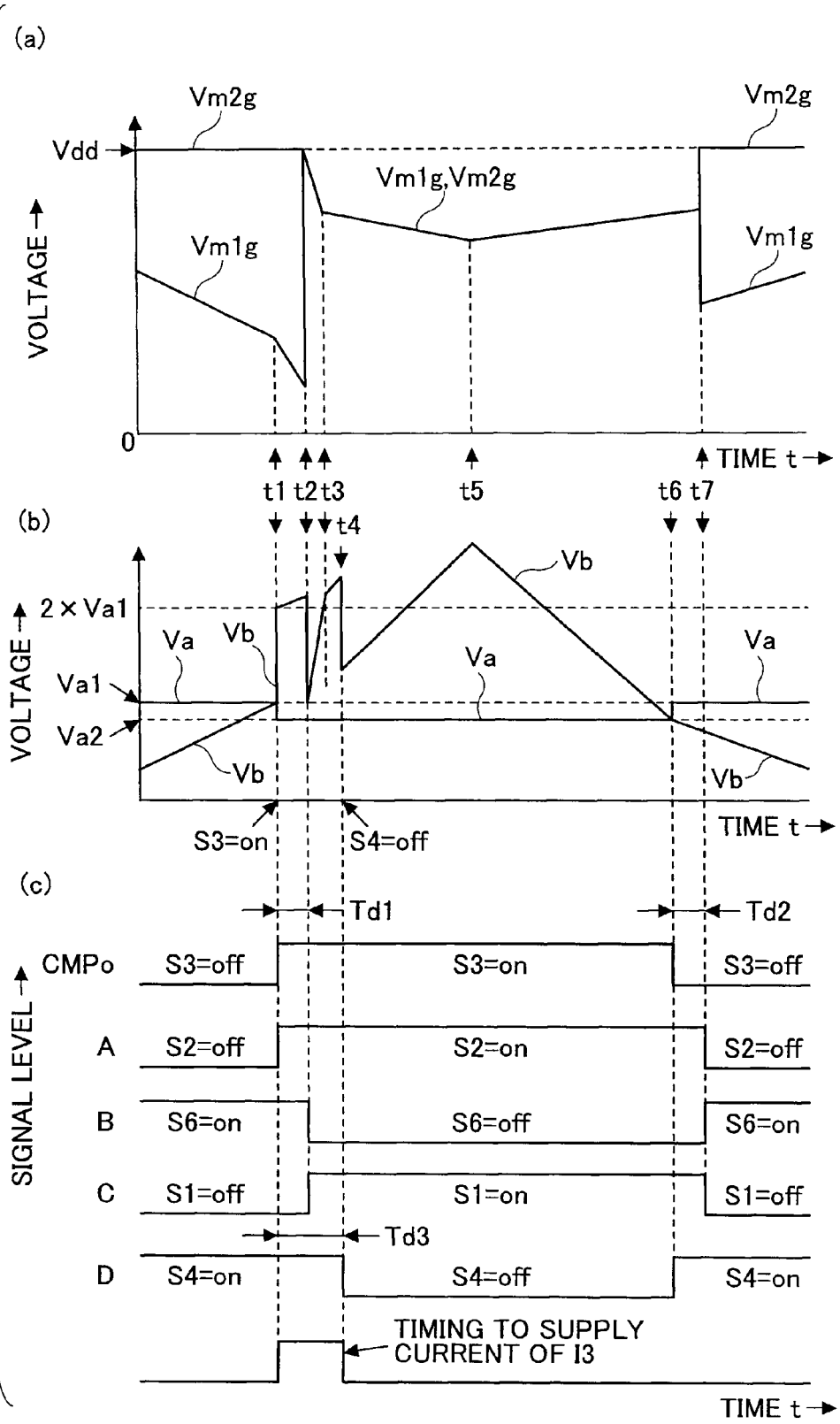
FIG. 2 is a timing chart of an operation of a major part in the constant voltage circuit shown in FIG. 1.

FIG. 2 is a timing chart of an operation of a major part in the constant voltage circuit shown in FIG. 1. Part (a) in FIG. 2 shows changes of a gate voltage Vm1*g* of the first output transistor M1 and a gate voltage Vm2*g* of the second output transistor M2 with respect to a time t. Part (b) in FIG. 2 shows changes of the voltage Va of the inverting input terminal and the voltage Vb of the non-inverting input terminal of the comparator 12 with respect to the time t. Part (c) in FIG. 2 shows changes of the output signal CMPo of the comparator 12, the output A of the inverter 14, the output B of the inverter 15, the output C of the inverter 16, and the output D of the inverter 19 in FIG. 1.

Next, an operation of the constant voltage circuit shown in FIG. 1 is described with reference to FIG. 2.

In a vertical axis of parts (a) and (b) of FIG. 2, Vdd denotes a voltage level of the input terminal voltage, Va1 denotes a voltage level of the first reference voltage Va1, and Va2 denotes a voltage level of the second reference voltage Va2. In a vertical axis of part (c) of FIG. 2, CMPo denotes an output signal level of the comparator 12, A denotes an output signal level of the inverter 14, B denotes an output signal level of the inverter 15, C denotes an output signal level of the inverter 16, and D denotes an output signal level of the inverter 19. The signals A, B, C, and D correspond to control signals of the switches S2, S6, S1, and S4, respectively.

In parts (a) to (c) of FIG. 2, in the initial state when the output current is 0 A, a current is not supplied to the resistor R4 since the first output transistor M1 and the PMOS transistor M3 form a current mirror circuit. Therefore, a voltage drop is not generated at the resistor R4. That is, the voltage Vb of the non-inverting input terminal of the comparator 12 is 0 V. On the other hand, the first reference voltage Va1 or the second reference voltage Va2 is applied to the inverting input terminal of the comparator 12. Therefore, the output CMPo of the comparator 12 is at an L-level. Since the output CMPo of the comparator 12 is at an L-level, the output A of the inverter 14 and the output C of the inverter 16 become L-level. On the other hand, the output B of the inverter 15 and the output D of the inverter 19 become H-level. Therefore, the switches S1 to S3 are turned off and the switches S4 and S6 are turned on (see FIG. 2(*c*)). The common terminal c of the switch S5 is connected to the terminal a at this time. Since the switch S1 is off and the switch S6 is on, the gate of the second output transistor M2 is pulled up to the input terminal voltage Vdd by the resistor R3. Therefore, the second output transistor M2 is off. Since the switch S2 is off, the current source I1 is supplied as a bias current of the differential amplifier 11. Since the switch S3 is off, the current of the current source I3 is not supplied to the resistor R4 even when the switch S4 is on. Further, since the common terminal c of the switch S5 is connected to the terminal a, the first reference voltage Va1 is connected to the inverting input terminal of the comparator 12.

In the aforementioned state, the output current is increased. When the output current is increased, the gate voltage Vm1*g* of the first transistor M1 is decreased (FIG. 2(*a*)). At the same time, the gate voltage of the PMOS transistor M3 is decreased. Therefore, the voltage Vb of the non-inverting input terminal of the comparator 12 is increased (FIG. 2(*b*)). However, connection states of the switches are not changed until the output current reaches a value of a predetermined first current value.

When the output current reaches the predetermined current value at a time t1, the voltage Vb reaches the first reference voltage Va1 (FIG. 2(*b*)). When the output current is further increased higher than the first current value, the voltage Vb becomes higher than the first reference voltage Va1. Therefore, the output CMPo of the comparator 12 is inverted to an H-level (FIG. 2(*c*)). Then, the switch S3 is turned on, therefore, the current of the current source I3 is supplied to the resistor R4. As a result, the voltage Vb rapidly rises (FIG. 2(*b*)). Note that the current value of the current source I3 in this embodiment is substantially equal to or larger than the drain current of the PMOS transistor M3, which flows when the output current becomes equal to the first current value. As shown in FIG. 2(*b*), the voltage Vb rises as high as (2×Va1), which is about twice as high as the first reference voltage Va1 at a timing of the time t1. Further, by the inversion of the output CMPo of the comparator 12, the common terminal c of the switch S5 is connected to the terminal b. Therefore, the second reference voltage Va2 is connected to the inverting input terminal of the comparator 12. Since the second reference voltage Va2 is set a little lower than the first reference voltage Va1, the inverting input terminal voltage Va of the comparator 12 is a little decreased from the voltage level Va1 to Va2 as shown in FIG. 2(*b*). Moreover, since the output of the comparator is at an H-level, an output of the inverter 13 becomes an L-level. Since an output circuit of the inverter 13 has low impedance on a low side, a charge of the capacitor C1 is discharged instantly. Therefore, since the input of the inverter 14 becomes L-level with little delay, the output A of the inverter 14 changes to an H-level in a moment when the output CMPo of the comparator 12 becomes an H-level (FIG. 2(*c*)). Moreover, when the output A of the inverter 14 becomes an H-level, the switch S2 is turned on. Therefore, a current value of the current source I2 is additionally provided to a bias circuit of the differential amplifier 11. As a result, the operation of the differential amplifier 11 becomes faster. Consequently, the voltage Vm1*g* drops rapidly after the time t1.

When the output A of the inverter 14 becomes an H-level, the output B of the inverter 15 changes from an H-level into an L-level. However, since the current source I5 is inserted between a power source on a negative side of the inverter 15 and ground potential Vss, the charge charged in the capacitor C2 when the output B of the inverter 15 is at an H-level is discharged through the current source I5. Thus, it takes time until the output B of the inverter 15 changes from an H-level to an L-level. This delay time is shown as Td1 in FIG. 2(*c*). After the time Td1, the output B of the inverter 15 becomes an L-level. When the voltage of the capacitor C2 becomes as low as or lower than an input threshold voltage of the inverter 16 at a time t2, the output C of the inverter 16 becomes an H-level almost at the same timing (FIG. 2(*c*)). Then, the switch S6 is turned off and the switch S1 is turned on. Then, the output of the differential amplifier 11 is inputted to the gate of the second output transistor M2. Before the switch S1 is turned on, the gate of the second output transistor M2 had been pulled-up to the input voltage Vdd by the resistor R3. Therefore, the gate voltage Vm2*g* of the second output transistor M2 had been the input voltage Vdd (FIG. 2(*a*)). Further, since there is gate capacitance of the second output transistor M2 between the gate of the second output transistor M2 and the input terminal Vdd, the output of the differential amplifier 11 momentarily rises as high as the input terminal voltage Vdd right after the switch S1 is turned on. Therefore, there is a moment when both the first output transistor M1 and the second output transistor M2 are turned off.

When both the first output transistor M1 and the second output transistor M2 are turned off, the PMOS transistors M3 and M4 are also turned off. Therefore, only a current of the current source I3 is supplied to the resistor R4. As described above, the output current of the current source I3 is substantially equal to the drain current of the PMOS transistor M3, which flows when the output current becomes equal to the first current value. Therefore, the voltage Vb drops almost as low as the first reference voltage Va1 (FIG. 2(*b*)). However, since the second reference voltage Va2 lower than the first reference voltage Va1 is inputted to the inverting input terminal of the comparator 12, the output CMPo of the comparator 12 is not inverted.

At a time t3, the charge in the gate capacitance of the second output transistor M2 is discharged by the output current of the differential amplifier 11. Then, the constant voltage circuit unit 1 switches to a stable operation. In this case, since the current value of the current source I3 is supplied to the resistor R4 in addition to the drain currents of the PMOS transistors M3 and M4, the voltage Vb becomes twice as high as the first reference voltage Va1 or higher (FIG. 2(*b*)). As described above, since the bias current of the differential amplifier 11 is increased by turning on the switch S2 before connecting the second output transistor M2 to the output of the differential amplifier 11 by turning on the switch S1, the differential amplifier 11 has a larger output current and is capable of faster response before the second output transistor M2 is connected. Therefore, less time is required to charge the gate capacitance of the second output transistor M2 by the output current of the differential amplifier 11 as compared to the case of turning on the switches S1 and S2 at the same time. As a result, fluctuation of an output voltage caused when the second output transistor M2 is connected can be suppressed.

When the output CMPo of the comparator 12 becomes an H-level at the time t1, the output of the inverter 17 changes from an H-level to an L-level. However, the current source I6 is inserted between the negative side power source of the inverter 17 and ground potential Vss. Therefore, the charge charged in the capacitor C3 when the inverter 17 outputs an H-level signal is slowly discharged through the current source I6. As a result, it takes time until the output of the inverter 17 changes from an H-level to an L-level. This delay time is shown as Td3 in FIG. 2(*c*). The delay time Td3 is longer than the delay time Td1. Moreover, the delay time Td3 is set as long as or longer than a time that it takes until the gate capacitance of the second output transistor M2 is discharged by the output of the differential amplifier 11. In this manner, the second output transistor M2 can be securely connected.

When the voltage of the capacitor C3 becomes as low as or lower than a threshold voltage of the inverter 18 at a time t4, the output of the inverter 18 becomes an H-level. Thus, the output D of the inverter 19 of a subsequent stage is an L-level (FIG. 2(*c*)). Then, the switch S4 is turned off to block the current of the current source I3 from being supplied to the resistor R4. Therefore, the voltage Vb drops by a voltage substantially equal to the first reference voltage Va1 (FIG. 2(*b*)).

In this manner, the switch S3 is turned on at the time t1 in accordance with the increase of the output current, thereby the current of the current source I3 is inputted to the comparator 12. In addition, the switch S2 is turned on almost at the same time, thereby the current source I2 is operated. The switch S1 is turned on at a time t2 with a delay of the time Td1 after the switch S3 is turned on. Then, since the second output transistor M2 can be operated, the circuit can receive a large load. In this manner, the current source I2 and the second output transistor M2 which are additionally provided are operated in the periods t1 to t4 including the periods t2 and t3 as transient periods. After the time t4, the current is in a large current mode (high speed mode). As described above, the second reference voltage Va2 has a voltage level lower than that of the first reference voltage Va1. When the voltage Vb becomes higher than the first reference voltage Va1 to invert the output CMPo of the comparator 12, the second reference voltage Va2 is inputted to the inverting input terminal of the comparator instead of the first reference voltage Va1. Therefore, the second output transistor M2 can be securely connected.

In this circuit configuration, the second output transistor M2 is larger in size than the first output transistor M1. Therefore, when the output current is increased, the switch S2 is turned on, the second output transistor M2 is turned on, and the switch S6 is turned off. Then, there is the moment when both the first and second output transistors M1 and M2 are turned off as described above. Then, a current flowing through the PMOS transistor M3 which monitors the first output transistor M1 is decreased. Then, the determination circuit unit 2 determines that the output current has decreased and ends up oscillating. To solve this problem, the determination circuit unit 2 has an oscillation preventive function. When the output current is small, the current flowing through the PMOS transistor M3 is small, therefore, the comparator 12 outputs an L-level signal while the output D of the inverter 19 becomes an H-level. Therefore, the switch S4 is on. When the output current gradually increases to be higher than the first current value 1, the output of the comparator 12 is inverted to an H-level, which turns on the switch S3 (the time t1 in FIG. 2(*c*)). At this time, since a signal inputted to the inverter 17 is delayed by the capacitor C3, the switch S4 remains on. In this manner, there is a time when both the switches S3 and S4 are on (Td3 in FIG. 2(*c*)). Therefore, the current of the current source I3 is supplied to the non-inverting input terminal of the comparator 12 as described above. Here, the switch S4 is on only for the delay time caused by the capacitor C3. After this delay time, the switch S4 is turned off, therefore, the current supply of the current source I3 is stopped at a time t4 (FIG. 2(*c*)). In the period of Td3, the first output transistor M1 and the second output transistor M2 are both operated, thereby a proper current is supplied to the PMOS transistors M3 and M4 which form a current mirror circuit. Therefore, when the output D of the inverter 19 becomes an L-level and the switch S4 is turned off, the voltage Vb becomes stable.

Next, the output current which has been increasing starts decreasing at a time t5. When the output current becomes as small as or smaller than the predetermined second current value at a time t6, the voltage Vb becomes lower than the second reference voltage Va2. As a result, the output CMPo of the comparator 12 is inverted from an H-level into an L-level (FIG. 2(*c*)). Then, the switch S3 is turned off. Further, since the output CMPo is at an L-level, the common terminal c of the switch S5 is connected to the terminal a, the first reference voltage Va1 is connected to the inverting input terminal of the comparator 12, and the input voltage Va of the inverting input terminal of the comparator 12 becomes Va1 (FIG. 2(*b*)). Moreover, since the output CMPo is at an L-level, the inverter 17 outputs an H-level signal. Here, since the output circuit of the inverter 17 has low impedance on a high side, the capacitor C3 can be instantly charged. As a result, an input signal to the inverter 18 becomes an H-level with little delay. Therefore, an output of the inverter 18 changes to an L-level soon after the output CMPo of the comparator 12 changes to an L-level. Therefore, the output D of the inverter 19 which receives the output of the inverter 18 changes to an H-level with little delay (FIG. 2(*c*)). When the output D of the inverter 19 becomes an H-level, the switch S4 is turned on. However, the current of the current source I3 is not supplied to the resistor R4 since the switch S3 is off at this time.

When the output CMPo of the comparator 12 becomes an L-level, the inverter 13 outputs an H-level signal. Since the current source I4 is connected between a power source terminal on a positive side of the inverter 13 and the input terminal Vdd, it takes time to charge the capacitor C1, causing a delay time of Td2 (FIG. 2(*c*)).

Therefore, the switch S2 is turned off at a time t7 after the delay time Td2 has passed after the output CMPo of the comparator 12 becomes an L-level. As a result, the current supply of the current source I2 as a bias current of the differential amplifier 11 is blocked, thereby only the current of the current source I1 is supplied as the bias current of the differential amplifier 11. Further, the output B of the inverter 15 which receives the L-level output A from the inverter 14 becomes an H-level. Then, since the high side of the inverter 15 has low impedance, the capacitor C2 is instantly charged. Therefore, when the output A of the inverter 14 becomes an L-level, the output C of the inverter 16 becomes an L-level immediately. As a result, the switch S1 is turned off (FIG. 2(*c*)), blocking a connection between the output of the differential amplifier 11 and a gate of the second output transistor M2. On the other hand, since the switch S6 is turned on, the gate voltage Vm2*g* of the second output transistor M2 is pulled-up to the input terminal Vdd by the resistor R3 to be as high as the input voltage Vdd (FIG. 2(*a*)). Moreover, since the gate of the first output transistor M1 is connected to the output of the differential amplifier 11, the gate voltage Vm1g drastically drops as shown in FIG. 2(a). When the connection between the differential amplifier 11 and the gate of the second output transistor M2 is blocked, the differential amplifier 11 charges only the gate capacitance of the first output transistor M1. Since the gate capacitance of the first output transistor M1 is small, the output voltage Vout is not changed even when the bias current is changed to only the current source I1 at the same time as blocking the connection between the differential amplifier 11 and the gate of the second output voltage Vout.

As described above, in the constant voltage circuit of this embodiment, the bias current of the differential amplifier 11 is changed in accordance with the output current. Therefore, a driving efficiency of the constant voltage circuit is improved when the output current is small. At the same time, a driving property of the constant voltage circuit is switched by connecting or blocking the second output transistor M2 in accordance with the output current. As a result, the constant voltage circuit is capable of high speed response when the output current is small and also receiving a large output current.

The bias current of the differential amplifier is changed in the constant voltage circuit disclosed in Patent Documents 1 and 2, however, a driving state of an output transistor is not changed in accordance with the output current in these conventional techniques. When switching the driving state in the present invention, a small output current mode (only the first output transistor M1 is operated) and a large output current mode (the first and second output transistors M1 and M2 are operated) are switched by comparing an output current with a predetermined output current value as a reference. At this time, there is an unstable period (for example, a period when the mode should originally be in the large output current mode but the modes are switched plural times) when switching the modes. This problem is solved as follows in the circuit configuration of this embodiment. Specifically, a predetermined voltage corresponding to the current source I3 is added to the voltage Vb at a timing of the time t1 shown in FIG. 2(b). Therefore, even when the voltage level of the voltage Vb becomes unstable in the period until the time t4, the voltage level of the voltage Vb does not become lower than the reference voltage Va2. As a result, a mode of the constant voltage circuit can be fixed to a required mode. In FIG. 2(b), after the voltage Vb becomes stable at the time t4, the constant voltage circuit operates in the large output current mode.

Further, since a ratio of a gate width to a gate length of the second output transistor M2 is set as high as or higher than a ratio of a gate width to a gate length of the first output transistor M1, a bias current value as large as or larger than the original bias current value is supplied to the differential amplifier 11. In this manner, a wide range of output voltage can be obtained.

Next, a second embodiment of the present invention is described with reference to FIGS. 3 and 4.

Figure 3:
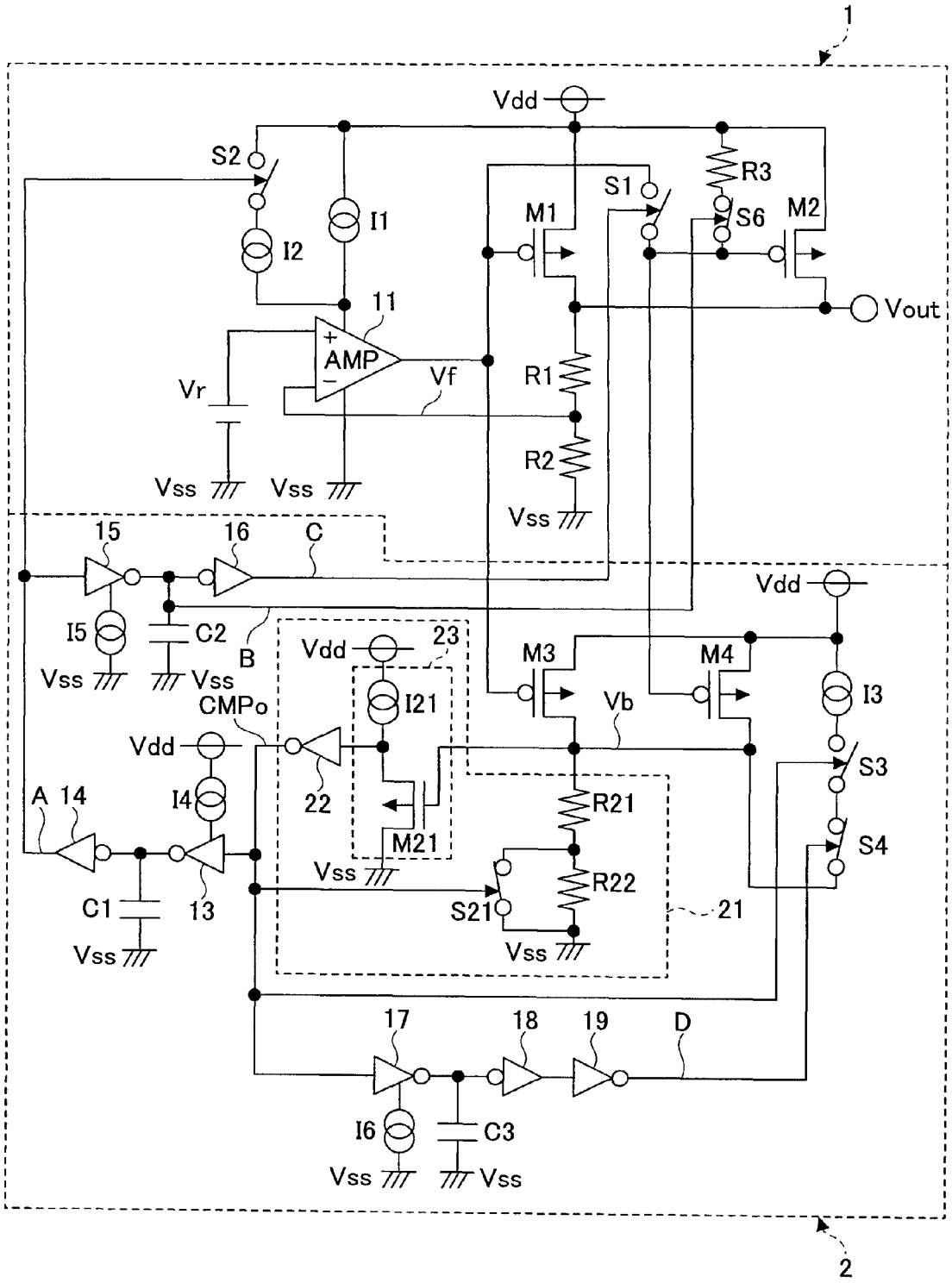
FIG. 3 is a constant voltage circuit of a second embodiment of the present invention.

FIG. 3 shows a constant voltage circuit showing the second embodiment of the present invention.

FIG. 3 is different from FIG. 1 in that a circuit 21 shown by a broken line is provided instead of a circuit 20 shown by a broken line in FIG. 1. That is, a constant current inverter 23 including resistors R21 and R22, a switch S21, an inverter 22, a power source voltage Vdd, a current source I21, and a PMOS transistor M21 is provided in FIG. 3 instead of the circuit including the resistor R4, the first reference voltage Va1, the second reference voltage Va2, the switch S5, and the comparator 12 shown in FIG. 1. Other than this difference, FIG. 3 has a configuration similar to that of FIG. 1, therefore, a description of FIG. 3 will be made on only the aforementioned difference.

In FIG. 3, drains of the PMOS transistors M3 and M4 are commonly connected and grounded through the resistors R21 and R22. The switch S21 is connected to both ends of the resistor R22 in parallel to the resistor R22. By turning on and off the switch S21, combined resistance of the resistors R21 and R22 is variably switched. The resistors R21 and R22 function as a current-voltage converter capable of converting a drain current of the PMOS transistors M3 and M4 into a voltage. As described above, the PMOS transistors M3 and M4 form a current mirror circuit with the first output transistor M1 and the second output transistor M2 respectively. Therefore, the drain current of the PMOS transistors M3 and M4 is in proportion to the output current. Since the resistors R21 and R22 convert this current into a voltage, a voltage drop Vb at the resistors R21 and R22 is in proportion to the output current. The current source I21 and the PMOS transistor M21 are connected in series between the power source voltage terminal Vdd and ground potential Vss. The current source I21 and the PMOS transistor M21 form a constant current inverter 23. A voltage Vb is inputted to a gate of the PMOS transistor M21. An output of the constant current inverter 23 is inputted to the inverter 22. An output CMPo of the inverter 22 is connected to a control terminal of the switch S21 to turn on and off the switch S21.

Figure 4:
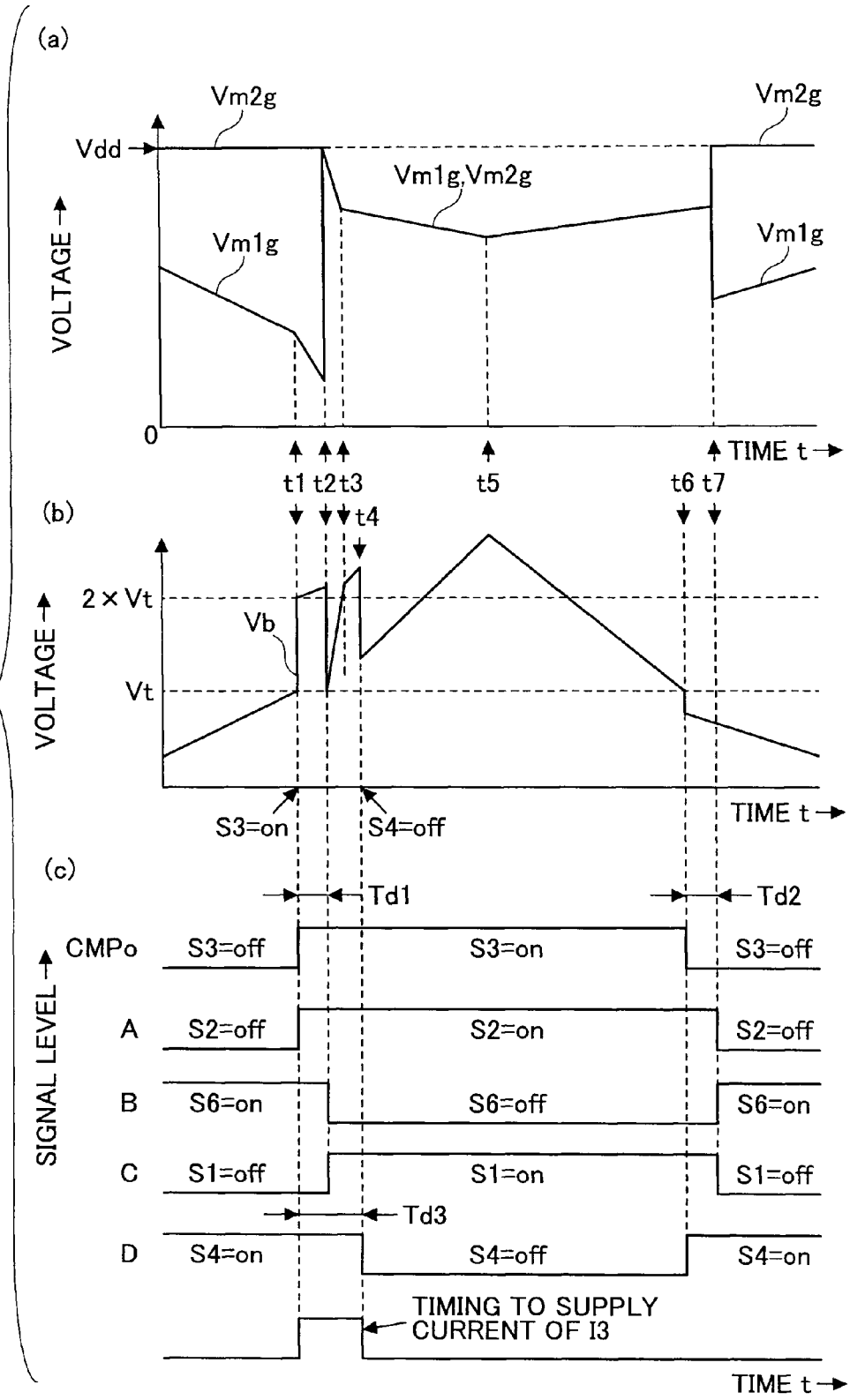
FIG. 4 is a timing chart of an operation of a major part in the constant voltage circuit shown in FIG. 3.

FIG. 4 is a timing chart showing a major part of the constant voltage circuit shown in FIG. 3. Part (a) in FIG. 4 shows changes of the gate voltage Vm1g of the first output transistor M1 with respect to a time t and of the gate voltage Vm2g of the second output transistor M2 with respect to a time t. Part (b) in FIG. 4 shows changes of the voltage Vb inputted to the gate of the PMOS transistor M21 with respect to the time t. Part (c) in FIG. 4 shows changes of a level of the output signal CMPo of the inverter 22, the output A of the inverter 14, the output B of the inverter 15, the output C of the inverter 16, and the output D of the inverter 19 in FIG. 3.

Here, parts (a) and (c) in FIG. 4 are the same as parts (a) and (c) in FIG. 2, however, the description made with reference to FIG. 2 will be repeated below to describe part (b) in FIG. 4.

In a vertical axis of part (a) in FIG. 4, Vdd denotes a voltage level of a voltage inputted to an input terminal. In a vertical axis of part (c) in FIG. 4, CMPo denotes an output signal level of the inverter 22, A denotes an output signal level of the inverter 14, B denotes an output signal level of the inverter 15, C denotes an output signal level of the inverter 16, and D denotes an output signal level of the inverter 19. The signals A, B, C, and D correspond to control signals of the switches S2, S6, S1, and S4 respectively. Moreover, in the vertical axis of part (b) in FIG. 4, Vt denotes a level of a threshold voltage of the constant current inverter 23.

In parts (a) to (c) of FIG. 4, the first output transistor M1 and the PMOS transistor M3 form a current mirror circuit. Therefore, since a current is not supplied to the resistor R21 in the initial state, that is when the output current is 0 A, a voltage drop is not caused by the resistor R21. That is, since the voltage Vb (input voltage Vb to the gate of the PMOS transistor M21) of the input terminal of the constant current inverter 23 formed of the current source I21 and the PMOS transistor M21 is 0 V, the output CMPo of the inverter 22 is at an L-level. Since the output CMPo of the inverter 22 is at an L-level, the output A of the inverter 14 and the output C of the inverter 16 are at an L-level. On the other hand, the output B of the inverter 15 and the output D of the inverter 19 become an H-level. Therefore, the switches S1 to S3 are turned off and the switches S4 and S6 are turned on (see FIG. 4(c)). The switches S1 to S4 and S6 are turned off when an L-level signal is inputted to their control terminals and turned on when an H-level signal is inputted to their control terminals. A switch which is turned on when an L-level signal is inputted to its control terminal and turned off when an H-level signal is inputted to its control terminal is used as the switch S21. Therefore, the switch S21 is turned on at this time (when the output CMPo is at an L-level). Note that a switch which is turned on when an H-level signal is inputted to its control terminal may be used as the switch S21 similarly to the other switches. In that case, the output CMPo may be inputted to the switch S21 through an inverter and the like.

Since the switch S1 is off and the switch S6 is on, the gate of the second output transistor M2 is pulled-up to the input terminal voltage Vdd by the resistor R3. Therefore, the second output transistor M2 is off. Since the switch S2 is off, the current of the current source I1 is supplied as a bias current of the differential amplifier 11. Further, since the switch S3 is off, the current of the current source I3 is not supplied to the resistor R21 even when the switch S4 is on. Since the switch S21 is on, a connection between the resistors R21 and R22 is grounded.

In the aforementioned state, the output current is increased. When the output current is increased, the gate voltage Vm1*g* of the first output transistor M1 is decreased (FIG. 4(*a*)). At the same time, the gate voltage of the PMOS transistor M3 is decreased. Therefore, the voltage Vb inputted to the input terminal of the constant current inverter 23 is increased (FIG. 4(*b*)). However, connection states of the switches are not changed until the output current reaches a level of a predetermined first current value.

When the output current reaches the predetermined first current value at a time t1, the voltage Vb becomes a threshold voltage Vt of the constant current inverter 23 (FIG. 4(*b*)). When the output current is further increased to be higher than the first current value, the voltage Vb becomes higher than the threshold voltage Vt of the constant current inverter 23. Therefore, the output CMPo of the inverter 22 is inverted to an H-level (FIG. 4(*c*)). Then, the switch S3 is turned on, therefore, the current of the current source I3 is supplied to the resistor R21. As a result, the voltage Vb rapidly rises (FIG. 4(*b*)). Note that the current value of the current source I3 in this embodiment is substantially equal to or higher than the drain current of the PMOS transistor M3, which flows when the output current becomes equal to the first current value. As shown in FIG. 4(*b*), the voltage Vb rises as high as (2×Vt), which is twice as high as the threshold voltage Vt of the constant current inverter 23 at a timing of the time t1. Further, by the inversion of the output CMPo of the inverter 22, the switch S21 is turned off. Therefore, the drain current of the PMOS transistor M21 and the current of the current source I3 are supplied to the resistors R21 and R22, which further increases the voltage Vb (a period from the time t1 to t2 in FIG. 4(*b*)). The output CMPo of the inverter 22 is at an H-level, therefore, the inverter 13 outputs an L-level signal. Since an output circuit of the inverter 13 has low impedance on a low side, a charge of the capacitor C1 is discharged instantly. Therefore, since the input of the inverter 14 becomes an L-level with little delay, the output A of the inverter 14 changes to an H-level in a moment when the output CMPo of the inverter 22 becomes an H-level (FIG. 4(*c*)). Moreover, when the output A of the inverter 14 becomes an H-level, the switch S2 is turned on. Therefore, a current value of the current source I2 is additionally provided to a bias circuit of the differential amplifier 11. As a result, the operation of the differential amplifier 11 becomes faster. Consequently, the voltage Vm1*g* drops rapidly after the time t1 as shown in FIG. 4(*a*).

When the output A of the inverter 14 becomes an H-level, the output B of the inverter 15 changes from an H-level into an L-level. However, since the current source I5 is inserted between a power source on a negative side of the inverter 15 and ground potential Vss, the charge charged in the capacitor C2 when the output B of the inverter 15 is at an H-level is discharged through the current source I5. Thus, it takes time until the output B of the inverter 15 changes from an H-level to an L-level. This delay time is shown as Td1 in FIG. 4(*c*). After the time Td1, the output B of the inverter 15 becomes an L-level. When the voltage of the capacitor C2 becomes as low as or lower than an input threshold voltage of the inverter 16 at a time t2, the output C of the inverter 16 becomes an H-level almost at the same timing (FIG. 4(*c*)). Then, the switch S6 is turned off and the switch S1 is turned on. Then, the output of the differential amplifier 11 is inputted to the gate of the second output transistor M2. Before the switch S1 is turned on, the gate of the second output transistor M2 had been pulled-up to the input voltage Vdd by the resistor R3. Therefore, the gate voltage Vm2*g* of the second output transistor M2 was the input voltage Vdd (FIG. 4(*a*)). Further, since there is gate capacitance of the second output transistor M2 between the gate of the second output transistor M2 and the input terminal Vdd, the output of the differential amplifier 11 momentarily rises as high as the input terminal voltage Vdd right after the switch S1 is turned on. Therefore, there is a moment when both the first output transistor M1 and the second output transistor M2 are turned off.

When both the first output transistor M1 and the second output transistor M2 are turned off, the PMOS transistors M3 and M4 are also turned off. Therefore, only a current of the current source I3 is supplied to the resistor R21. As described above, the output current of the current source I3 is set substantially equal to or larger than the drain current of the PMOS transistor M3 which flows when the output current becomes equal to the first current value. Therefore, the voltage Vb drops almost as low as the threshold voltage Vt of the constant current inverter 23 (FIG. 4(*b*)). However, since a voltage generated at the resistors R21 and R22 is inputted to the constant current inverter 23 at this time, an output of the constant current inverter 23 is not inverted.

At a time t3, when the gate capacitance of the second output transistor M2 is discharged by the output current of the differential amplifier 11, the constant voltage circuit unit 1 operates stably. In this case, since the current value of the current source I3 is supplied to the resistors R21 and R22 in addition to the drain current of the PMOS transistors M3 and M4, the voltage Vb becomes twice as high as the threshold voltage Vt of the constant current inverter 23 or higher (FIG. 4(*b*)). As described above, since the bias current of the differential amplifier 11 is increased by turning on the switch S2 before connecting the second output transistor M2 to the output of the differential amplifier 11 by turning on the switch S1, the output current of the differential amplifier 11 becomes larger and a response speed becomes faster before the second output transistor M2 is connected. As a result, a response speed becomes higher. Therefore, less time is required to charge the gate capacitance of the second output transistor M2 by the output current of the differential amplifier 11 as compared to the case of turning on the switches S1 and S2 at the same time. As a result, fluctuation of an output voltage caused when the second output transistor M2 is connected can be suppressed.

When the output CMPo of the inverter 22 becomes an H-level at the time t1, the output of the inverter 17 changes from an H-level to an L-level. However, the current source I6 is inserted between the negative side power source of the inverter 17 and ground potential Vss. Therefore, the charge charged in the capacitor C3 when the inverter 17 outputs an H-level signal is slowly discharged through the current source I6. As a result, it takes time until the output of the inverter 17 changes from an H-level to an L-level. This delay time is shown as Td3 in FIG. 4(*c*). The delay time Td3 is longer than the delay time Td1. Moreover, the delay time Td3 is set as long as or longer than a time that it takes until the gate capacitance of the second output transistor M2 is discharged by the output of the differential amplifier 11. In this manner, the second output transistor M2 can be securely connected.

When the voltage of the capacitor C3 becomes as low as or lower than a threshold voltage of the inverter 18 at a time t4, the output of the inverter 18 becomes an H-level. Thus, the output D of the inverter 19 of a subsequent stage is an L-level (FIG. 4(*c*)). Then, the switch S4 is turned off to block the current of the current source I3 from being supplied to the resistors R21 and R22. Therefore, the voltage Vb drops by a voltage substantially equal to the threshold voltage Vt of the constant current inverter 23 (FIG. 4(*b*)).

In this manner, the switch S3 is turned on at the time t1 in accordance with the increase of the output current, thereby the current of the current source I3 is inputted to the constant current inverter 23. In addition, the switch S2 is turned on almost at the same time, thereby the current source I2 is operated. The switch S1 is turned on at a time t2 with a delay of the time Td1 after the switch S3 is turned on. Then, since the second output transistor M2 can be operated, the circuit can receive a large load. In this manner, the current source I2 and the second output transistor M2 which are additionally provided are operated in the periods t1 to t4 including the periods t2 and t3 as transient periods. After the time t4, the circuit is in a large current mode (high speed mode). As described above, when the voltage Vb becomes higher than the threshold voltage Vt of the constant current inverter 23 and the output CMPo of the inverter 22 is inverted, the switch S21 is turned off so that the voltage generated at the resistors R21 and R22 is inputted to the constant current inverter 23. Therefore, the second output transistor M2 can be securely connected.

In this circuit configuration, the second output transistor M2 is larger in size than the first output transistor M1. Therefore, when the output current is increased, the switch S2 is turned on, the second output transistor M2 is turned on, and the switch S6 is turned off. Then, there is the moment when both the first and second output transistors M1 and M2 are turned off as described above. Then, a current flowing through the PMOS transistor M3 which monitors the first output transistor M1 is decreased. The determination circuit unit 2 determines that the output current has decreased and ends up oscillating. To solve this problem, the determination circuit unit 2 has an oscillation preventive function. When the output current is small, the current flowing through the PMOS transistor M3 is small, therefore, the constant current inverter 23 outputs an H-level signal while the output D of the inverter 19 becomes an L-level. Therefore, the switch S4 is on. When the output current gradually increases to be higher than the first current value, the output of the constant current inverter 23 is inverted to an L-level, which turns on the switch S3 (the time t1 in FIG. 4(*c*)). At this time, since a signal inputted to the inverter 17 is delayed by the capacitor C3, the switch S4 remains on. In this manner, there is a time when both the switches S3 and S4 are on (Td3 in FIG. 4(*c*)). Therefore, the current of the current source I3 is supplied to the constant current inverter 23 as described above. Here, the switch S4 is on only for the delay time caused by the capacitor C3. After this delay time, the switch S4 is turned off, therefore, the current supply of the current source I3 is stopped at the time t4 (FIG. 4(*c*)). In the period of Td3, the first output transistor M1 and the second output transistor M2 are both operated, thereby a proper current is supplied to the PMOS transistors M3 and M4 which form a current mirror circuit. Therefore, when the output D of the inverter 19 becomes an L-level and the switch S4 is turned off, the voltage Vb becomes stable.

Next, the output current which has been increasing starts decreasing at a time t5. When the output current becomes as small as or smaller than the predetermined second current value at a time t6, the voltage Vb becomes lower than the threshold voltage Vt of the constant current inverter 23. As a result, the output CMPo of the inverter 22 is inverted from an H-level into an L-level (FIG. 4(*c*)). Then, the switch S3 is turned off. Further, since the output CMPo is at an L-level, the switch S21 is turned on and the connection between the resistors R21 and R22 is grounded through the switch S21. Moreover, since the output CMPo is at an L-level, the inverter 17 outputs an H-level signal. Here, since the output circuit of the inverter 17 has low impedance on a high side, the capacitor C3 can be charged instantly. As a result, an input signal to the inverter 18 becomes an H-level with little delay. Therefore, an output of the inverter 18 changes to an L-level soon after the output CMPo of the comparator 12 changes to an L-level. Therefore, the output D of the inverter 19 which receives the output of the inverter 18 changes to an H-level with little delay (FIG. 4(*c*)). When the output D of the inverter 19 becomes an H-level, the switch S4 is turned on. However, the current of the current source I3 is not supplied to the resistor R21 since the switch S3 is off at this time.

When the output CMPo of the inverter 22 becomes an L-level, the inverter 13 outputs an H-level signal. Since the current source I4 is connected between a power source terminal on a positive side of the inverter 13 and the input terminal Vdd, it takes time to charge the capacitor C1, causing a delay time of Td2 (FIG. 4(*c*)).

Therefore, the switch S2 is turned off at a time t7 after the delay time Td2 has passed after the output CMPo of the inverter 22 becomes an L-level. As a result, the current supply of the current source I2 as a bias current to the differential amplifier 11 is blocked, thereby only the current of the current source I1 is supplied as the bias current of the differential amplifier 11. Further, the output B of the inverter 15 which receives the L-level output A from the inverter 14 becomes an H-level. Then, since the high side of the inverter 15 has low impedance, the capacitor C2 is charged instantly. Therefore, when the output A of the inverter 14 becomes an L-level, the output C of the inverter 16 becomes an L-level immediately. As a result, the switch S1 is turned off (FIG. 4(*c*)), blocking a connection between the output of the differential amplifier 11 and a gate of the second output transistor M2. On the other hand, since the switch S6 is turned on, the gate voltage Vm2*g* of the second output transistor M2 is pulled-up to the input terminal Vdd by the resistor R3 to be as high as the input voltage Vdd (FIG. 4(*a*)). Moreover, since the gate of the first output transistor M1 is connected to the output of the differential amplifier 11, the gate voltage Vm1*g* drastically drops as shown in FIG. 4(*a*). When the connection between the differential amplifier 11 and the gate of the second output transistor M2 is blocked, the differential amplifier 11 charges only the gate capacitance of the first output transistor M1. Since the gate capacitance of the first output transistor M1 is small, the output voltage Vout is not changed even when the bias current is changed to only the current source I1 at the same time as blocking the connection between the differential amplifier 11 and the gate of the second output voltage Vout.

As described above, in the constant voltage circuit of this embodiment, the bias current of the differential amplifier 11 is changed in accordance with the output current. Therefore, a driving efficiency of the constant voltage circuit is improved when the output current is small. At the same time, a driving property of the constant voltage circuit is changed by connecting or blocking the second output transistor M2 in accordance with the output current. As a result, the constant voltage circuit is capable of high speed response when the output current is small and can also receive a large output current.

Similarly to the first embodiment, a small output current mode and a large output current mode are switched in accordance with the output current value in the second embodiment. As a countermeasure for a defect in a period when the circuit operation becomes unstable (the period from the time t1 to t4 in FIG. 4(*b*)), a predetermined voltage corresponding to the current source I3 is added to the voltage Vb at the timing of the time t1. As a result, the voltage Vb does not fall lower than the voltage Vt even when the voltage Vb is unstable (specifically, in a manner similar to the corresponding description in the first embodiment).

Figure 5:
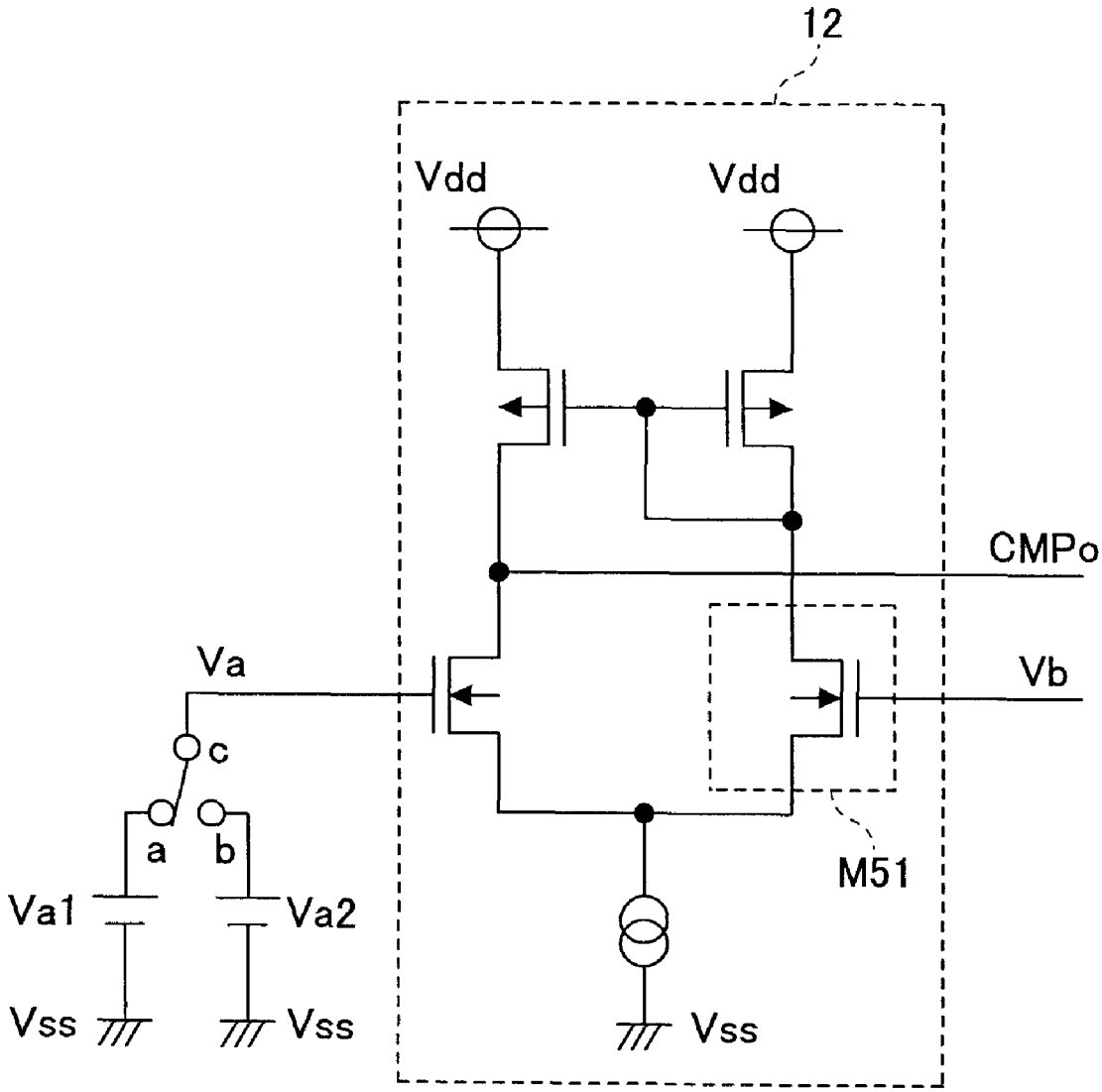
FIG. 5 is a diagram showing a detail of a comparator 12 shown in FIG. 1.

In the second embodiment, an equivalent function to the first embodiment can be obtained with a simpler circuit configuration. On the other hand, although the circuit is not operated unless the current of the current source I21 of the constant current inverter 23 is supplied, the NMOS transistor M51 (the NMOS transistor 51 having a gate which receives the voltage Vb. See FIG. 5) of the differential amplifier circuit which forms the comparator 12 is off when the voltage Vb is low. Therefore, the first embodiment has an advantage in that the current is not unnecessarily consumed and thus the power consumption is suppressed. In this manner, the first and second embodiments have different advantages.

In general, an operational amplifier has a capacitor connected in an amplifier stage for phase compensation. Next, a phase compensation of the constant voltage circuit of this embodiment is described.

Figure 6:
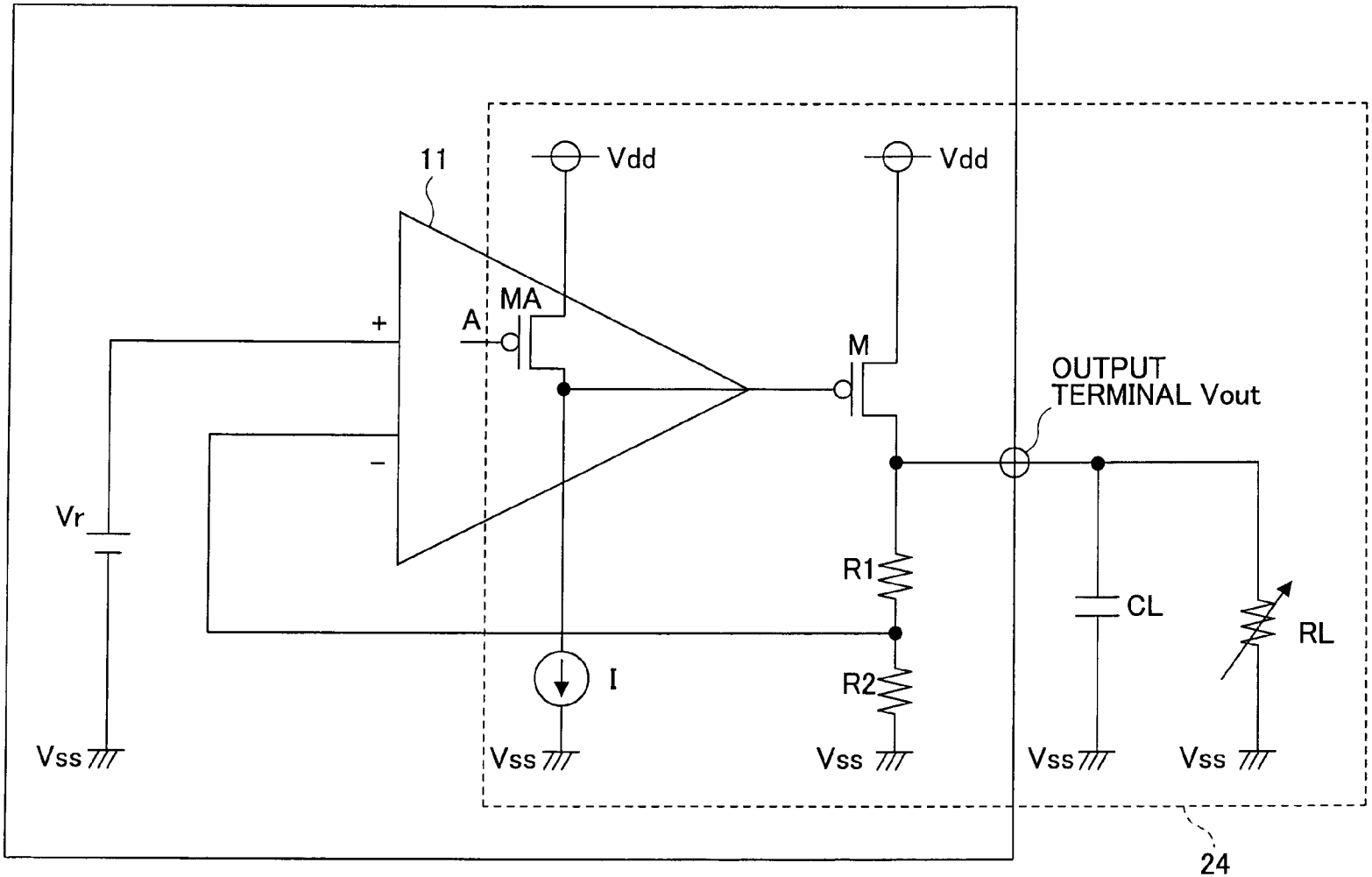
FIG. 6 shows an integrated stabilizing power source circuit provided in a periphery of a first output transistor M1 and a second output transistor M2 in the constant voltage circuit shown in FIG. 1.
Figure 7:
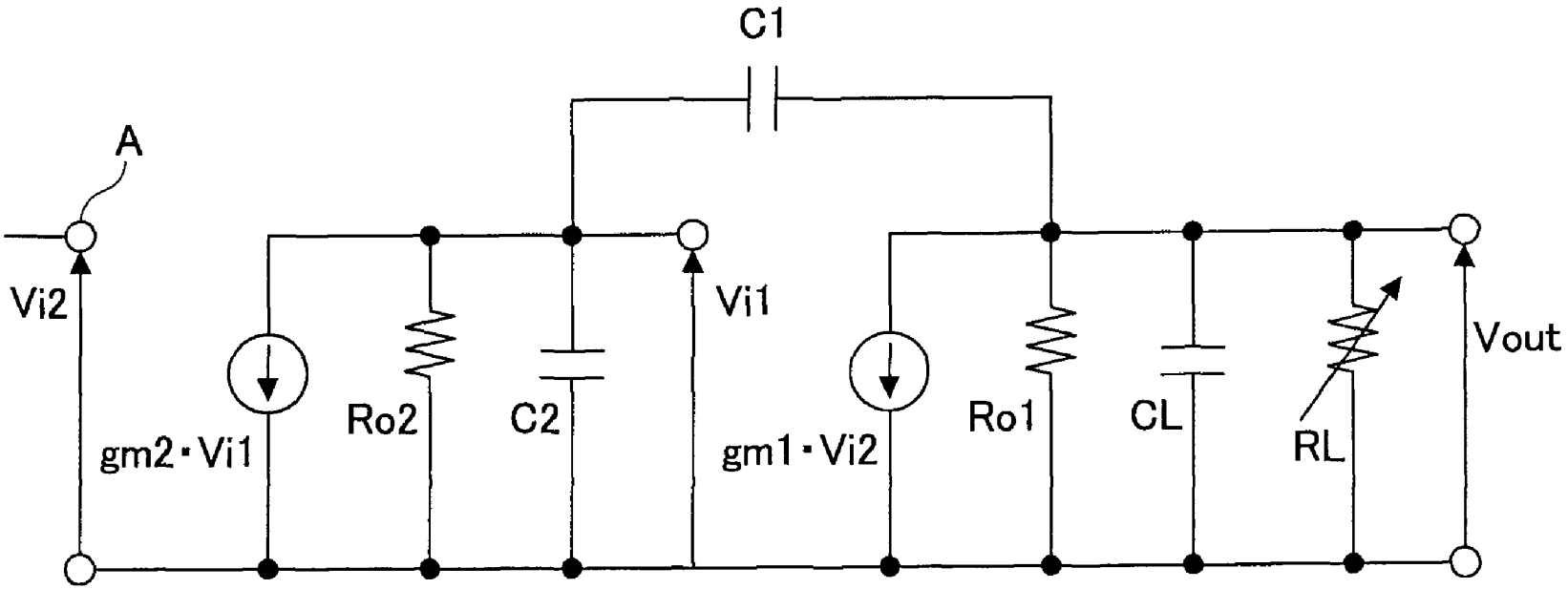
FIG. 7 shows a small signal equivalent circuit of an area 20 shown in FIG. 3.
Figure 8:
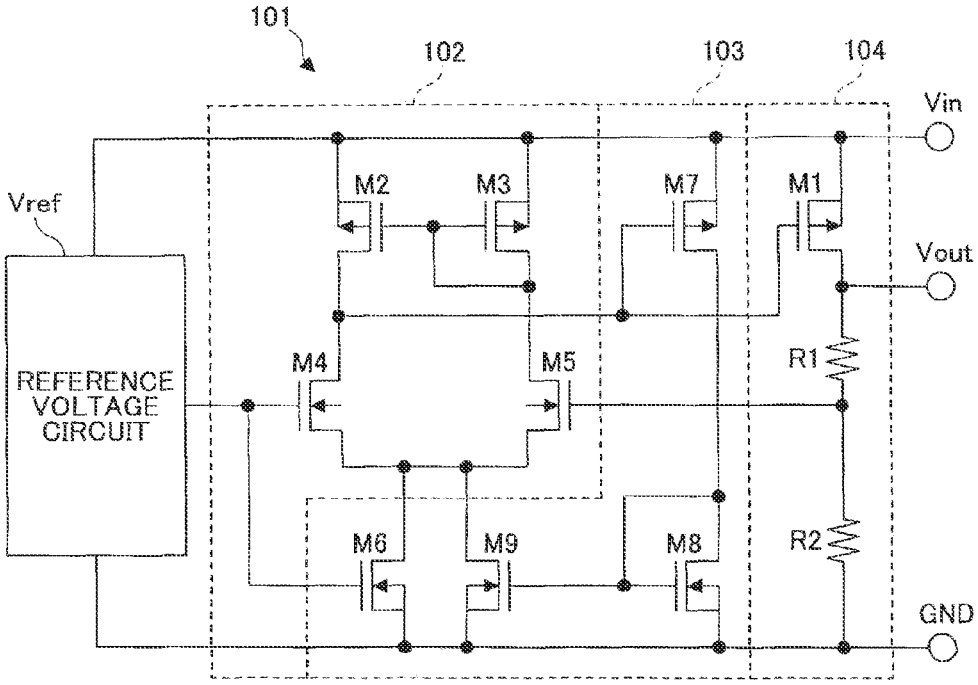
FIG.8 Prior Art
FIG. 8 shows a conventional constant voltage circuit.

In FIG. 6, an area surrounded by a solid line denotes an integrated stabilizing power source circuit, which is a circuit around the first output transistor M1 and the second output transistor M2 in the constant voltage circuit shown in FIG. 1. In FIG. 6, the first output transistor M1 and the second output transistor M2 when the output current is large in FIG. 1 are combined and shown as one output transistor M. The same components as those in FIG. 1 are denoted by the same reference numerals and the description will not be repeated. FIG. 7 shows a small signal equivalent circuit of an area 24 surrounded by a broken line in FIG. 6.

In FIG. 6, MA denotes a transistor included as an internal circuit of the differential amplifier 11, and I denotes a current source. In addition, a load resistor RL and a capacitor CL for stabilizing an output signal are connected to an output terminal Vout.

In FIG. 7, reference numeral Ro1 denotes resistance between a source and a drain of an output transistor M; Ro2 denotes resistance between a source and a drain of the transistor MA; gm1 denotes transconductance of the output transistor M; gm2 denotes transconductance of the transistor MA; Vi1 denotes a gate voltage of the output transistor M; Vi2 denotes a gate voltage of the transistor MA; C1 denotes capacitance between the gate and drain of the output transistor M; C2 denotes capacitance between the gate and drain of the transistor MA; CL denotes capacitance of a capacitor for stabilizing the output signal, which is connected to this stabilizing power source circuit; and RL denotes variable load resistance connected to this stabilizing power source circuit.

In the equivalent circuit of FIG. 7, there are two poles, namely a pole p1 and a pole p2. Frequencies Fp1 and Fp2 at which the poles p1 and p2 are generated respectively are approximately obtained by the formulas below.

$$Fp1=1/(2\pi gm1\cdot Ro2\cdot RL\cdot C1) \quad \text{Formula 1}$$

$$Fp2=1/(2\pi\cdot CL\cdot RL) \quad \text{Formula 2}$$

Here, when the load resistance RL increases (that is when the output current becomes small), the frequencies Fp1 and Fp2 of the two poles p1 and p2 are both shifted to the low frequency side and become close to each other as in Formulas 1 and 2. Then, the output of the differential amplifier 11 is fed back to the input before the gain is sufficiently decreased. Since the input and output have opposite phases at this time, the circuit oscillates. In the constant voltage circuit of this embodiment, only the first output transistor M1 is used when the output current is small. Therefore, C1 in Formula 1 becomes a small value. As a result, it can be prevented that the frequencies of the poles p1 and p2 become close to each other, therefore, the circuit does not oscillate.

In this manner, according to the present invention, oscillation of the circuit can be suppressed and power consumption can be reduced to be small when the output current is small. In addition, since the second output transistor M2 is additionally used when the output current is large, the circuit can perform a high speed operation.

According to one embodiment, the constant voltage circuit of the present invention can operate stably for a wide range of load current without decreasing a response speed even when the load current is small.

This patent application is based on Japanese Priority Patent Application No. 2008-025194 filed on Feb. 5, 2008, and Japanese Priority Patent Application No. 2008-081336 filed on Mar. 26, 2008, the entire contents of which are hereby incorporated herein by reference.

What is claimed is:

1. A constant voltage circuit configured to convert an input voltage into an output voltage having a predetermined level, the constant voltage circuit comprising:

a differential amplifier circuit configured to produce an output signal having a voltage level determined in response to a reference voltage and the output voltage; and an output circuit configured to receive the output signal and produce an output current in response to the voltage level of the output signal, the output voltage being proportional to the current, wherein the output circuit includes plural output transistors and a transistor selecting unit configured to select one or more output transistors to be operated among the plural output transistors to produce the current depending on the level of the output voltage;

a supply unit having plural current sources to supply a bias current from at least one of the plural current sources to the differential amplifier circuit; and a determination circuit configured to receive the output voltage and select one or more current sources to be operated amongst the plural current sources depending on the level of the output voltage.

2. A constant voltage circuit configured to convert an input voltage into an output voltage having a predetermined level, the constant voltage circuit comprising:

a differential amplifier circuit configured to produce an output signal having a voltage level determined in response to a reference voltage and the output voltage;

an output circuit including at least a first transistor, a second transistor, and a first switching unit configured to supply a current supplied by the second transistor to be added to a current supplied by the first transistor to produce a combined current or block the current supplied by the second transistor depending on the voltage level of the output signal of the differential amplifier circuit, said output circuit being configured to produce an output current of the current supplied by the first transistor or the combined current in response to the voltage level of the output signal of the differential amplifier circuit, the output voltage being proportional to the output current;

a bias current supply circuit including at least a first current source, a second current source, and a second switching unit configured to supply a current supplied by the second current source to be added to a current supplied by the first current source to produce a combined current source or block the current supplied by the second current source, said bias current supply circuit being configured to supply a bias current of the first current source or the combined current source to the differential amplifier circuit; and a determination circuit configured to control switching of the second switching unit depending on the voltage level of the output signal of the differential amplifier circuit.

3. The constant voltage circuit as claimed in claim 2, wherein the determination circuit further includes a unit for monitoring the output current;

only the current of the first current source is supplied as the bias current to the differential amplifier circuit when the output current has a smaller value than a predetermined current value; and the current of the second current source is added to the current of the first current source to be supplied as the bias current to the differential amplifier circuit by controlling the first switching unit when the output current becomes as high as or higher than the predetermined current value.

4. A constant voltage circuit configured to convert an input voltage into an output voltage having a predetermined level, said constant voltage circuit comprising:

a voltage input terminal;

a voltage output terminal;

a constant voltage circuit unit; and a determination circuit unit, wherein the constant voltage circuit unit includes an output circuit and a differential amplifier circuit;

the output circuit includes a first transistor, a second transistor, a first switching unit, and a sixth switching unit, said first and second transistors having sources connected together to the voltage input terminal, drains connected together to the voltage output terminal, and gates connected to each other through the first switching unit, the gate of the second transistor being connected to the voltage input terminal through the sixth switching unit;

the differential amplifier circuit has a non-inverting input terminal receiving a first reference voltage, an inverting input terminal receiving a divided voltage of the output voltage, an output terminal connected to the gate of the first transistor, a first current source and a second current source connected in parallel to each other as bias current supply sources, and a second switching unit connected between the first and second current sources;

the determination circuit unit includes a current supply circuit and a comparator, the current supply circuit including a third transistor and a fourth transistor having sources connected together to the voltage input terminal, drains connected to each other, and gates connected to the gates of the first and second transistors respectively, said determination circuit unit further includes a third current source, a third switching unit, and a fourth switching unit which are connected in series between the sources and drains of the third and fourth transistors in parallel to the third and fourth transistors, the comparator having a non-inverting input terminal connected to the drains of the third and fourth transistors which are connected together and an inverting input terminal to which one of a second reference voltage and a third reference voltage is selectively connected through a fifth switching unit, and an output terminal to output an output signal; and the first, second, and sixth switching units in the constant voltage circuit unit and the third to fifth switching units in the determination circuit unit are controlled by the output signal of the comparator.

5. The constant voltage circuit as claimed in claim 4, further comprising a second delay circuit between the output terminal of the comparator and at least one of the first and second switching units.

6. The constant voltage circuit as claimed in claim 4, further comprising:

a first delay circuit between the output terminal of the comparator and the fourth switching unit; and a second delay circuit between the output terminal of the comparator and at least one of the first and second switching units, wherein a delay time caused by the first delay circuit is longer than a delay time caused by the second delay circuit, and the delay time-caused, by the first delay circuit is equal to or longer than a time taken for a gate voltage of the second transistor to be discharged by the output signal of the differential amplifier circuit.

7. The constant voltage circuit as claimed in claim 4, further comprising a converter capable of converting a drain current flowing through the third and fourth transistors which are connected together into a converted voltage.

8. The constant voltage circuit as claimed in claim 7, wherein a current value of the third current source is set equal to or higher than an output current value of the third transistor which is obtained when an output current of the constant voltage circuit reaches a predetermined current value; a voltage level of the second reference voltage is set equal to or higher than a level of the converted voltage of the converter obtained when the output current of the constant voltage circuit reaches the predetermined current value; and a voltage level of the third reference voltage is set lower than the voltage level of the second reference voltage.

9. The constant voltage circuit as claimed in claim 4, further comprising a first delay circuit between the output terminal of the comparator and the fourth switching unit.

10. The constant voltage circuit as claimed in claim 4, wherein a ratio of a gate width to a gate length of the second transistor is as high as or higher than a ratio of a gate width to a gate length of the first transistor, and the current of the second current source is as large as or larger than the current of the first current source.

* * * * *